US006952985B1

(12) United States Patent
Hsien

(10) Patent No.: US 6,952,985 B1
(45) Date of Patent: Oct. 11, 2005

(54) ADJUSTABLE SPANNER

(76) Inventor: Chin-Ching Hsien, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/804,038

(22) Filed: Mar. 19, 2004

(51) Int. Cl.[7] ..... B25B 13/46
(52) U.S. Cl. ..... 81/165; 81/170
(58) Field of Search ..... 81/165–167, 170

(56) References Cited

U.S. PATENT DOCUMENTS 1,484,374 A * 2/1924 Illig ..... 81/165
1,617,488 A * 2/1927 Johnson ..... 81/165

* cited by examiner

*Primary Examiner*—David B. Thomas

(57) ABSTRACT

An adjustable spanner comprises a holding portion installed at one end of the spanner body; a retaining jaw installed at another end of the spanner body; a movable jaw installed to the retaining jaw; the movable jaw being slidable along a slide track at a head portion of the spanner body. Two sides of the upper end of the slide track are formed with respective auxiliary projecting track. Two lower sides of a lower edge of the movable jaw are formed with respective slopes so as to enhance the strength of the structure. The slopes are configured to be matchable to the two auxiliary projecting tracks. Each auxiliary projecting track is extended from a respective upper surface of the slide track with an angle between 60 to 85 degrees so as to enhance the strength of the adjustable spanner.

1 Claim, 2 Drawing Sheets

ADJUSTABLE SPANNER

FIELD OF THE INVENTION

The present invention relates to spanners, and particularly to an adjustable spanner with a stronger strength for suffering from a larger twisting force.

BACKGROUND OF THE INVENTION

In general, an adjustable spanner must be used to screw various kinds of screwing element. As a result, the adjustable spanner is easy to be destroyed. Thus, it is very necessary that the adjustable spanner has a stronger strength for suffering from stronger twisting force. In one prior art, the spanner body of the adjustable spanner has a sliding track for receiving a movable jaw. The track has a reverse Ω slot. However the sliding track is in contact with the movable jaw in a small area so that the structure strength is low. Moreover, in some prior art, an enhancing structure is installed at an upper side of the movable jaw, but most of the stress is concentrated in the neck portion of the movable jaw so that the effect of enhancing the structure is low, and thus the movable jaw be destroyed as it is used for a longer time.

SUMMARY OF THE INVENTION

Accordingly, the primary object of the present invention is to provide an adjustable spanner which comprises a holding portion installed at one end of the spanner body; a retaining jaw installed at another end of the spanner body; a movable jaw installed to the retaining jaw; the movable jaw being slidable along a slide track at a head portion of the spanner body. Two sides of the upper end of the slide track are formed with respective auxiliary projecting track. Two lower sides of a lower edge of the movable jaw are formed with respective slopes so as to enhance the strength of the structure. The slopes are configured to be matchable to the two auxiliary projecting tracks. Each auxiliary projecting track is extended from a respective upper surface of the slide track with an angle between 60 to 85 degrees so as to enhance the strength of the adjustable spanner.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
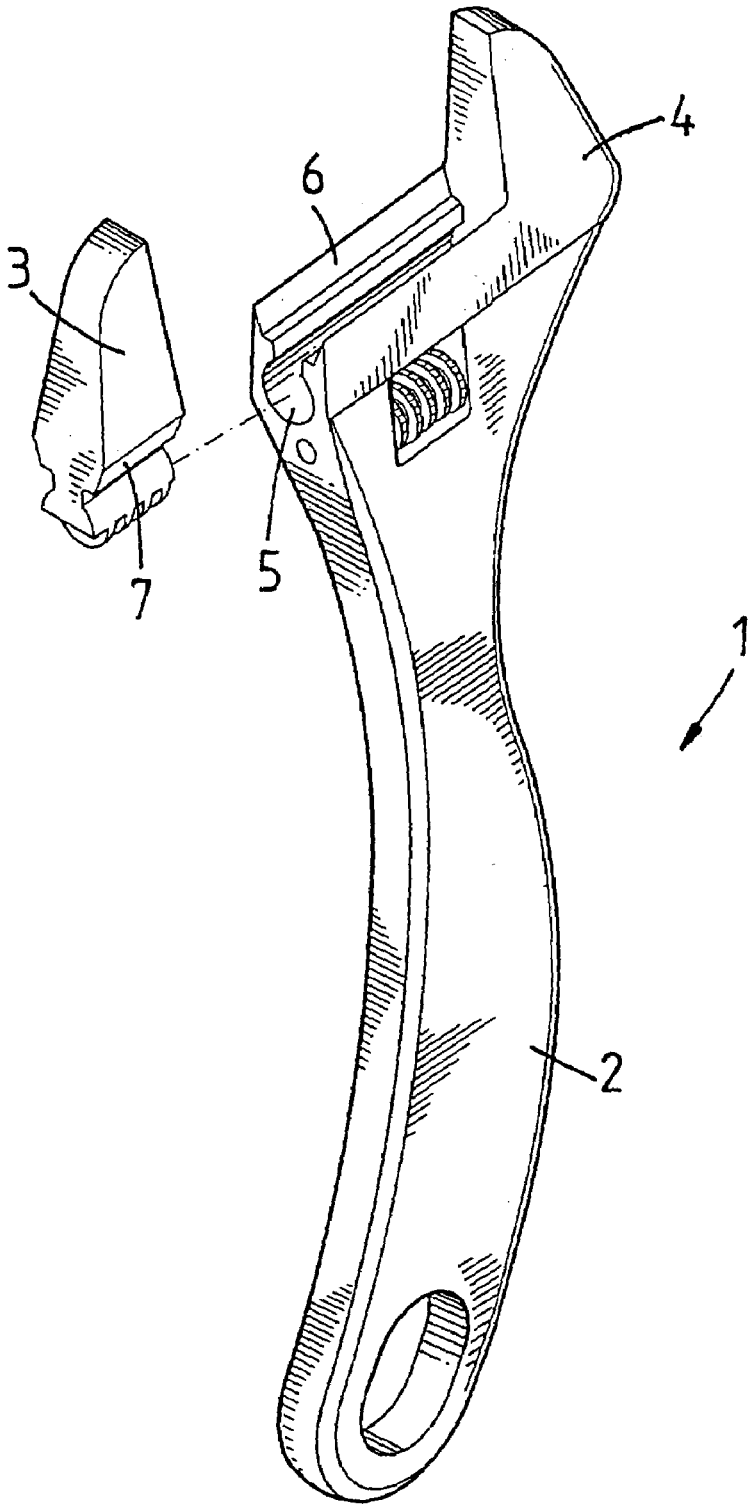
FIG. 1 is an exploded perspective view of the present invention.
Figure 2:
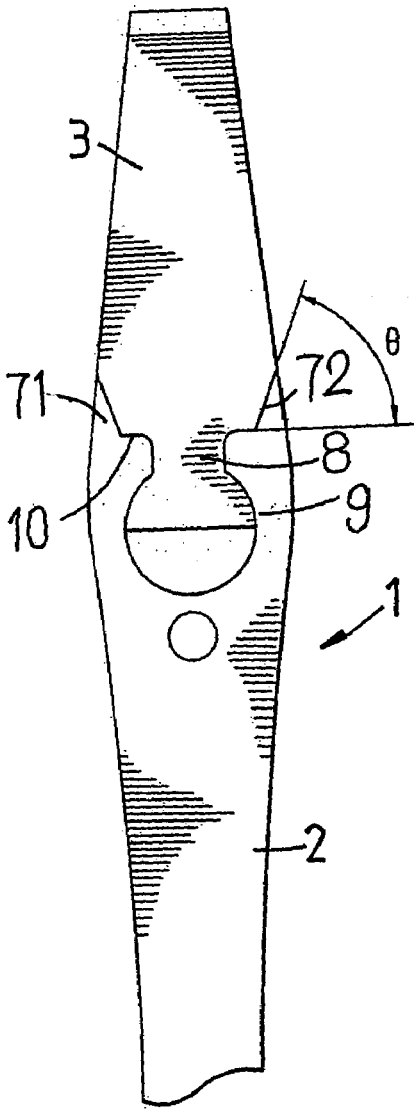
FIG. 2 is a lateral view of the present invention wherein the adjustable spanner is assembled.
Figure 3:
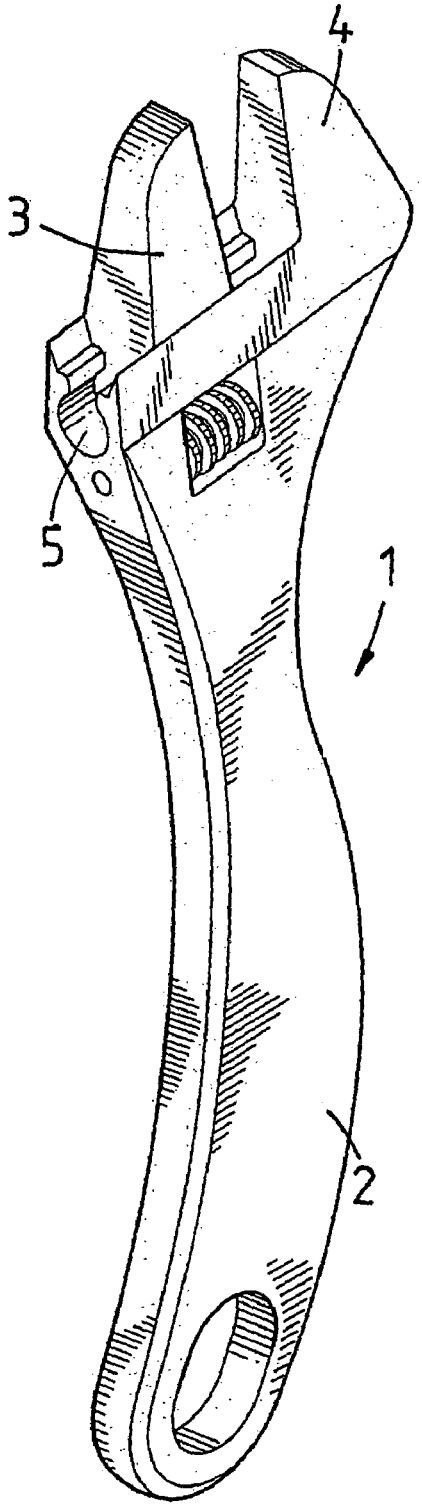
FIG. 3 is a perspective view of the adjustable spanner of the present invention, wherein the adjustable spanner is assembled.

With reference to FIGS. 1 and 2, the adjustable spanner of the present invention is illustrated. The adjustable spanner has the following element.

A holding portion 2 is at one end of the spanner body 1.

A retaining jaw 4 is at another end of the spanner body 1.

A movable jaw 3 is installed to the retaining jaw 4. The movable jaw 3 is slidable along a slide track 5 at a head portion of the spanner body 1.

Two sides of the upper end of the slide track 5 are formed with respective auxiliary projecting tracks 6.

Two lower sides of a lower edge of the movable jaw 3 are formed with respective slopes 7 so as to enhance the strength of the structure. The slopes 7 are configured to be matchable to the two auxiliary projecting tracks 6. Each auxiliary projecting track 6 is extended from a respective upper surface of the slide track 5 with an angle between 60 to 85 degrees so as to have a preferred enhancing effect.

Furthermore, in the present invention, referring to FIG. 2, the lower side of the movable jaw 3 has a plane 10. A neck portion 8 is extended from the plane 10 of the movable jaw 3; and a round cylindrical engaging portion 9 is extended from a lower side of the neck portion 8. The two slopes 7 are two inclined planes 71, 72. The inclined planes 71, 72 are reduced toward the neck portion 8 so as to enhance the strength of the structure. The inclined planes 71, 72 are configured to be matchable to the two auxiliary projecting tracks. Each auxiliary projecting track is extended from a respective upper surface of the slide track with an angle between 60 to 85 degrees so as to enhance the strength of the adjustable spanner. The movable jaw 3, the neck portion 8 and the round cylindrical engaging portion 9 are integrally formed.

In use of the present invention, if a larger twisting force is applied to the spanner body 1. Since the lower end of the movable jaw 3 has two slopes 7 so as to increase the contact area between two auxiliary projecting tracks 6 and the movable jaw 3 so that the force can be transferred effectively and the spanner body 1 can suffer a larger twisting force. Moreover, the movable jaw 3 is fixed to the spanner body 1 with a larger area so that it has a preferred effect than the prior art spanner with a reverse Ω shape.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An adjustable spanner comprising:

a holding portion installed at one end of the spanner body;

a retaining jaw installed at another end of the spanner body;

a movable jaw installed to the retaining jaw; the movable jaw being slidable along a slide track at a head portion of the spanner body; and the lower side of the movable jaw having a plane;

a neck portion extended from the plane of the movable jaw; and a round cylinder engaging portion extended from a lower side of the neck portion;

wherein two sides of the upper end of the slide track are formed with respective auxiliary projecting track; two sides of a lower edge of the movable jaw are formed with respective inclined planes; the inclined planes are reduced toward the neck portion so as to enhance the strength of the structure; the inclined planes are configured to be matchable to the two auxiliary projecting tracks; each auxiliary projecting track is extended from a respective upper surface of the slide track with an angle between 60 to 85 degrees so as to enhance the strength of the adjustable spanner; and wherein the movable jaw, the neck portion and round cylinder engaging portion are integrally formed.

* * * * *